US009359104B2

(12) United States Patent
Kizer et al.

(10) Patent No.: US 9,359,104 B2
(45) **Date of Patent: *Jun. 7, 2016**

(54) CONFIGURABLE SHIPPING CONTAINER

(71) Applicant: Celanese Acetate LLC, Irving, TX (US)

(72) Inventors: Lawton E. Kizer, Blacksburg, VA (US); Raymond M. Robertson, Blacksburg, VA (US)

(73) Assignee: Celanese Acetate LLC, Irving, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/883,783

(22) Filed: Oct. 15, 2015

(65) Prior Publication Data

US 2016/0031589 A1 Feb. 4, 2016

Related U.S. Application Data

(62) Division of application No. 14/202,382, filed on Mar. 10, 2014.

(60) Provisional application No. 61/779,350, filed on Mar. 13, 2013.

(51) Int. Cl.

| | |
|---|---|
| ***B65D 5/64*** | (2006.01) |
| ***B65D 5/50*** | (2006.01) |
| ***B65D 5/32*** | (2006.01) |
| ***B65D 5/49*** | (2006.01) |

(52) U.S. Cl.

CPC ..... *B65D 5/503* (2013.01); *B65D 5/328* (2013.01); *B65D 5/48026* (2013.01); *B65D 5/64* (2013.01)

(58) Field of Classification Search

USPC ..... 229/141, 125.01, 117.02, 122.3, 229/122.27; 206/45.3

See application file for complete search history.

(56) References Cited

U.S. PATENT DOCUMENTS

| | | | | |
|---|---|---|---|---|
| 3,193,152 | A * | 7/1965 | White, Jr. ..... | B65D 85/64 222/182 |
| 4,043,502 | A * | 8/1977 | Croley ..... | B65D 5/326 222/528 |
| 9,211,972 | B2 | 12/2015 | Kizer et al. | |
| 2005/0040063 | A1 * | 2/2005 | Churvis ..... | B65D 77/067 206/386 |

FOREIGN PATENT DOCUMENTS

| | | | |
|---|---|---|---|
| WO | 2012047346 | A1 | 4/2012 |
| WO | 2012047347 | A1 | 4/2012 |
| WO | 2012047348 | A1 | 4/2012 |
| WO | 2012047349 | A1 | 4/2012 |

* cited by examiner

*Primary Examiner* — Christopher Demeree

(74) *Attorney, Agent, or Firm* — McDermott Will & Emery LLP

(57) ABSTRACT

Shipping containers for porous masses may include a bottom lid having a rectangular lid bottom and four bottom rims that are each continuous with the lid bottom; a tray comprising a tray bottom and four tray sidewalls that are each continuous with the tray bottom defining an interior with an open top; and a top lid having a rectangular lid top and four top rims that are each continuous with the lid top, wherein the tray is configured to be placed on a bottom lid with the bottom rims surrounding a portion of the tray with a top lid placed over the top of the tray with the top rims surrounding a portion of the tray.

9 Claims, 8 Drawing Sheets

CONFIGURABLE SHIPPING CONTAINER

BACKGROUND

The present invention relates to shipping containers and, in particular, to systems and methods for providing a shipping container for multiple items that are both fragile and heavy.

Producing segmented filters for smoking devices generally involves utilizing filter rods having the filter segment composition, cutting the filter rods to segments or an appropriate length, and combining the segments in a desired order to achieve a segmented filter rod that can be used for attaching to smokeable substances like tobacco columns. Conventional filter rods for cigarettes typically consist of acetate cellulose, are about 5-8 mm in diameter, about 150 mm long, and about 0.9 g or less in weight. Other filter rods for segmenting generally adhere to the dimensions of the convention filter rods so as to mitigate the need for changes to existing machinery.

In some instances, filter rods may be produced at one location and shipped to a second (typically a different manufacturer) for assembling the segmented filters and, in some instances, the corresponding smoking devices.

Porous masses described herein can be incorporated into smoking device filters and have been shown to reduce, and sometimes significantly reduce, the concentration of contaminants or toxicants in a smoke stream. Porous masses generally include a plurality of binder particles and a plurality of active particles bound together at contact points, which is described in more detail herein. In some instances, porous masses may weigh about 2 to about 5 times more than a comparably sized conventional cellulose acetate filter rod, which may depend on the diameter of the filter rods. Further, porous masses can be fragile and prone to chipping, denting, cracking, and the like, due, at least in part, to the bound nature of the structure and the composition of the binder materials. As such, shipping containers may, in some embodiments, have different strength and design parameters than conventional cellulose acetate filter rods shipping.

BRIEF DESCRIPTION OF THE DRAWINGS

The following figures are included to illustrate certain aspects of the present invention, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

The present invention relates to shipping containers and, in particular, to systems and methods for providing a shipping container for multiple items that are both fragile and heavy.

In some embodiments, the shipping containers described herein may advantageously have a structure that allows for the shipment of porous masses with mitigated risk for breaking, cracking, chipping, or denting the porous masses.

Typically, shipping containers, or trays therein, are loaded by mechanical arms (or the like) or workers by lifting and tipping the trays to allow the filter rods to fall into a hopper of the combining machine (or other suitable machinery). Because of the increased weight of the porous mass rods, the shipping containers described herein may comprise multiple trays that allow for the standard machinery to appropriately process.

As used herein, the term "tray" refers to a container designed to contain a quantity of filter rods in an upright position. A tray is discussed herein as being generally a rectangular shape having a length, width, and height, wherein the height is less than the length or width, but may be provided in other forms or in other proportions. A shipping container may comprise one or more trays.

It should be noted that when "about" is provided herein in reference to a number in a numerical list, the term "about" modifies each number of the numerical list. It should be noted that in some numerical listings of ranges, some lower limits listed may be greater than some upper limits listed. One skilled in the art will recognize that the selected subset will require the selection of an upper limit in excess of the selected lower limit.

Figure 1:
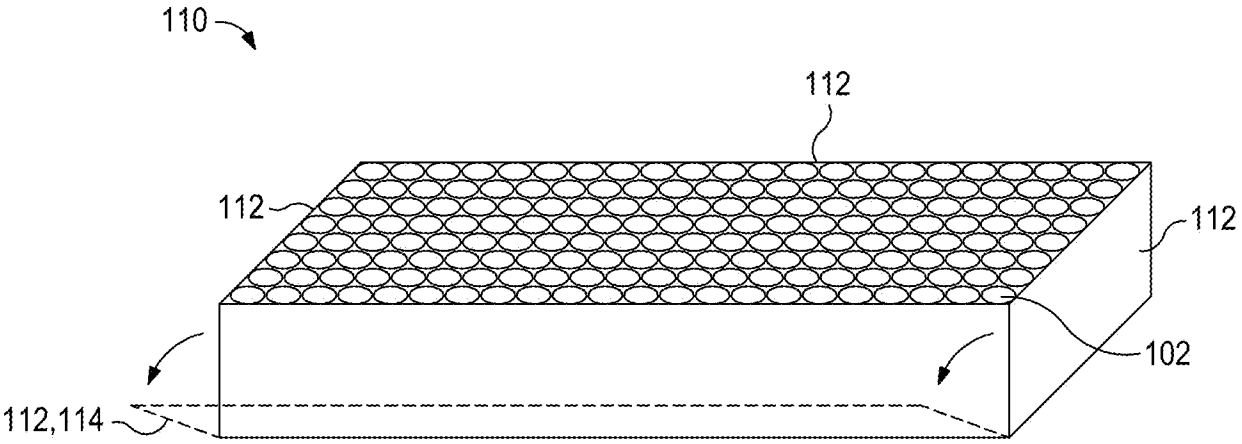
FIG. 1 provides an illustration of tray according to some embodiments described herein.

FIG. 1 provides an illustration of tray 110 with porous mass rods 102 positioned upright therein. As illustrated, tray 110 has four sidewalls 112 with one being flap 114. Flap 114 may advantageously allow for loading porous mass rods 102 into a hopper of a combining machine.

Figure 2A:
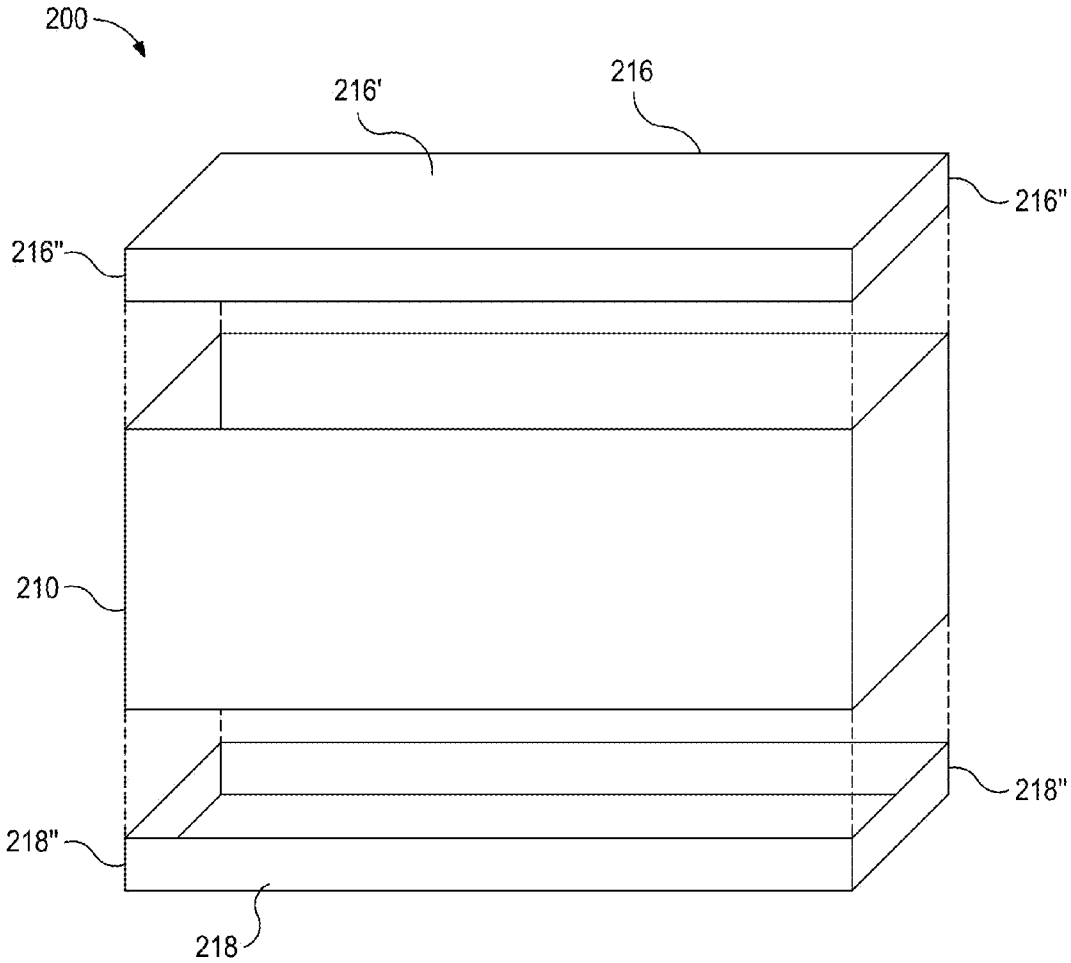
FIGS. 2A-B provide a perspective view of an exemplary shipping container according to some embodiments described herein.
Figure 2B:
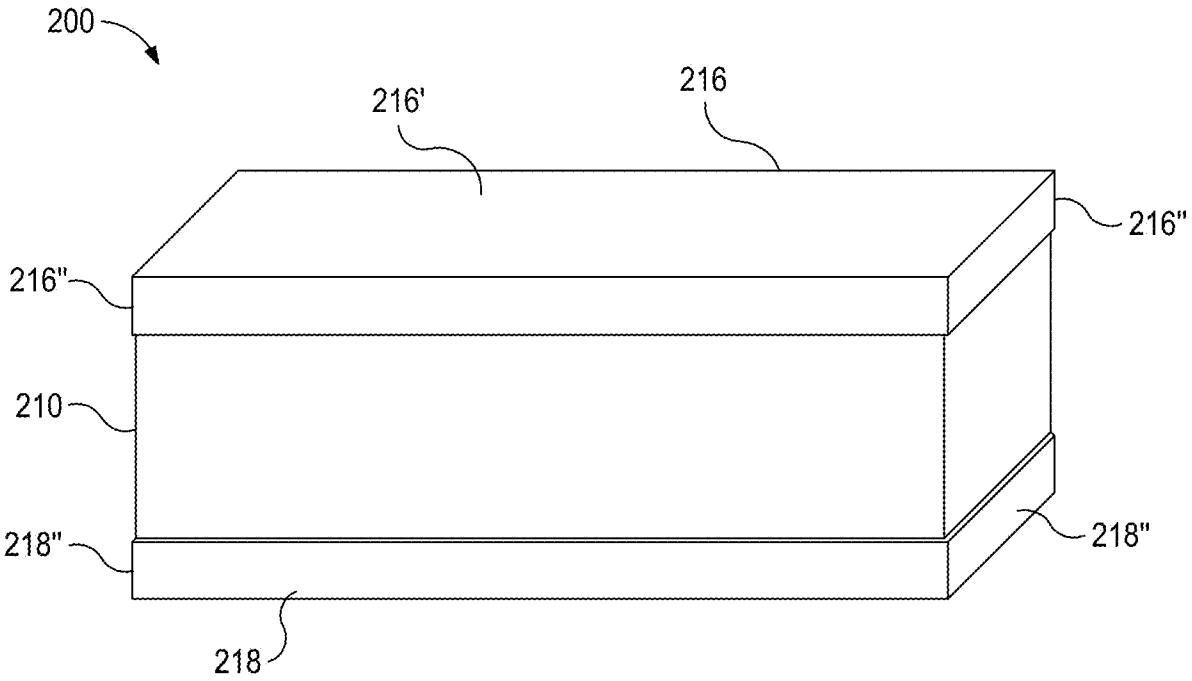

FIGS. 2A-B provide a perspective view of an exemplary shipping container 200 according to some embodiments of the present disclosure. Shipping container 200 includes tray 210, top lid 216, and bottom lid 218, where top lid 216 and bottom lid 218 are, in this embodiment, identical. Each lid 216,218 has a length, width, and height with a rectangular lid panel 216',218' (218' not shown) and rims 216",218" that are each continuous with the corresponding lid panel 216',218'. In certain embodiments, the length of the lid 216,218 is greater than the width that is greater than the height. Such configurations may advantageously provide additional support to the bottom and corners of tray 210 from top lid 216 and bottom lid 218. In some instances, top lid 216 and bottom lid 218 may be configured to touch when placed on tray 210.

In some embodiments, the lids may have a rectangular lid with four rims and dimensions sized to hold the tray or trays of the shipping container. In some embodiments, a shipping container may comprise a bottom lid having a rectangular lid bottom and four bottom rims that are each continuous with the lid bottom; a tray comprising a tray bottom and four tray sidewalls that are each continuous with the tray bottom defining an interior with an open top; and a top lid having a rectangular lid top and four top rims that are each continuous with the lid top, wherein the tray is configured to be placed on a bottom lid with the bottom rims surrounding a portion of the tray with a top lid placed over the top of the tray with the top rims surrounding a portion of the tray.

Figure 3A:
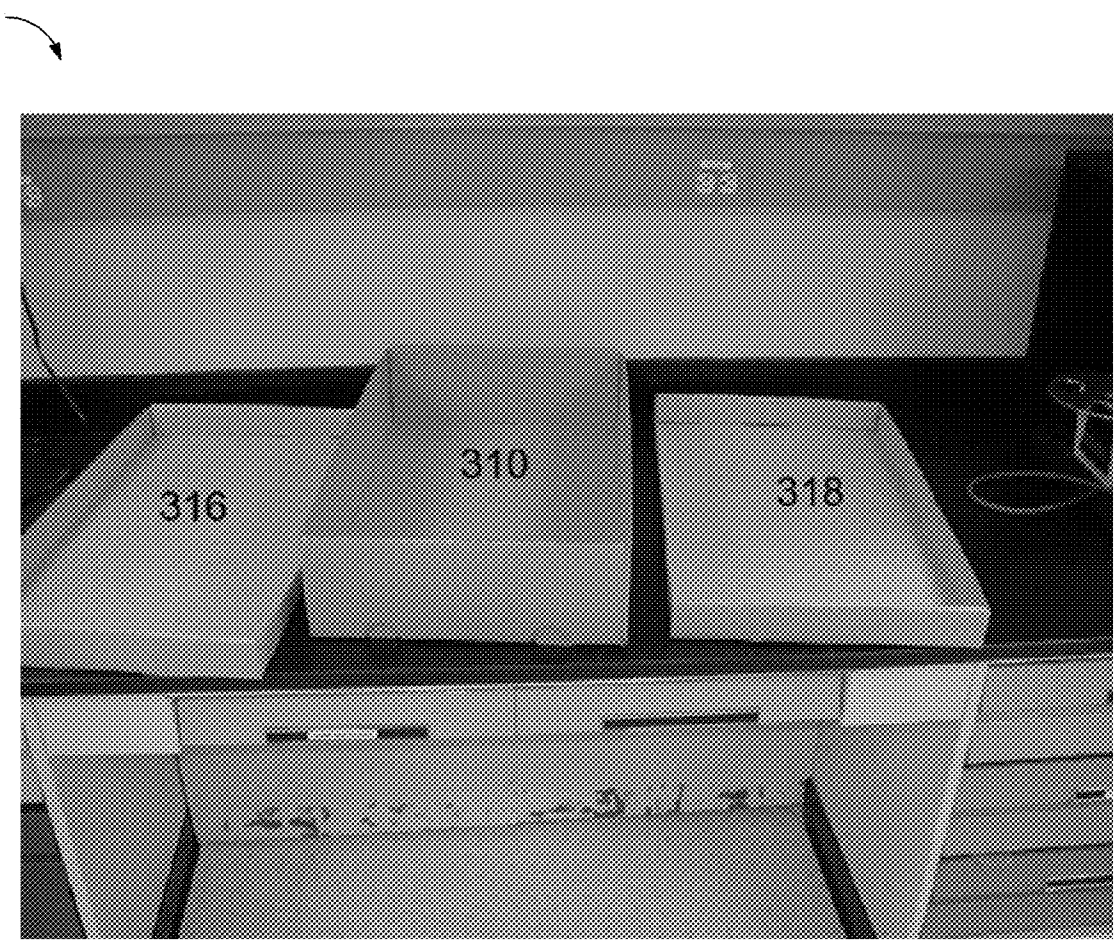
FIGS. 3A-C provide photographs of an exemplary shipping according to some embodiments described herein.
Figure 3B:
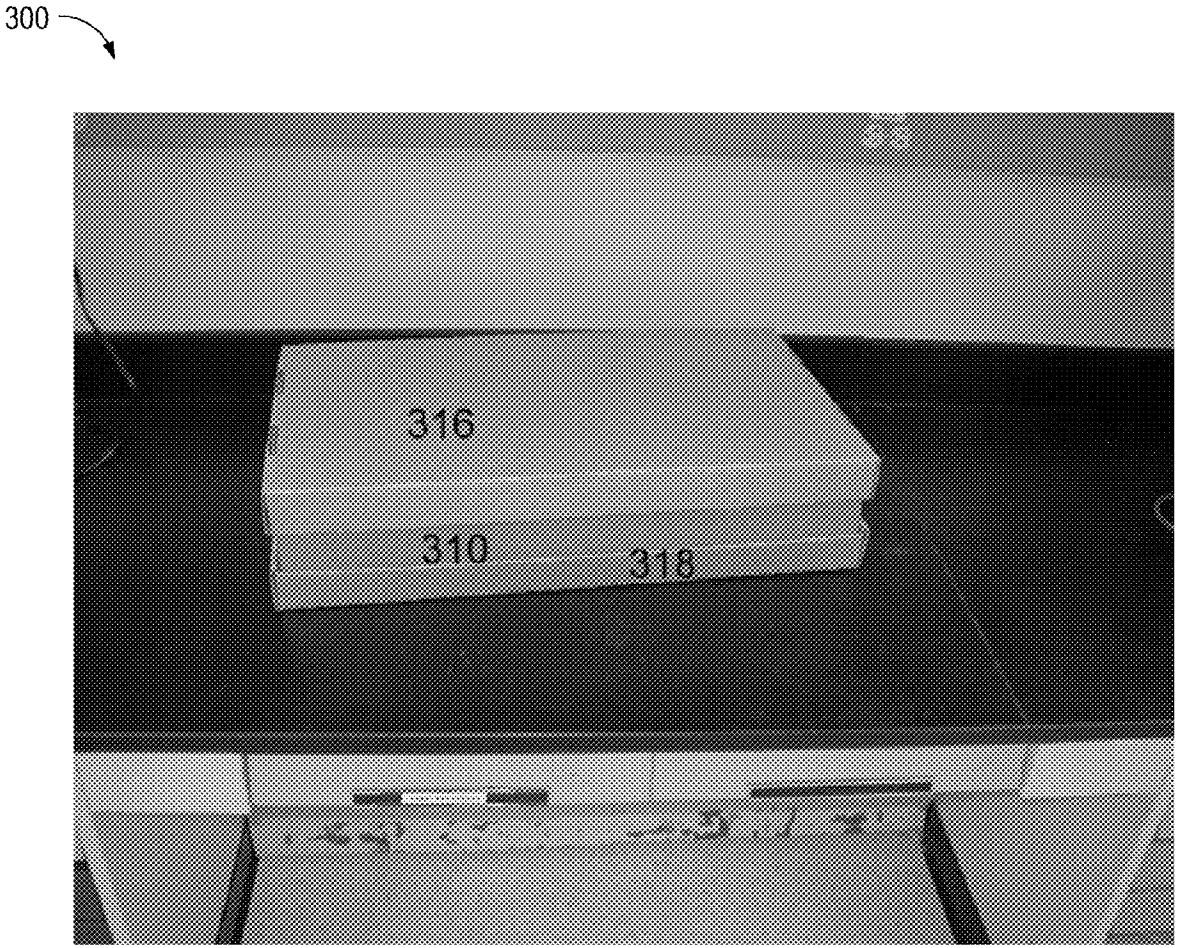
Figure 3C:
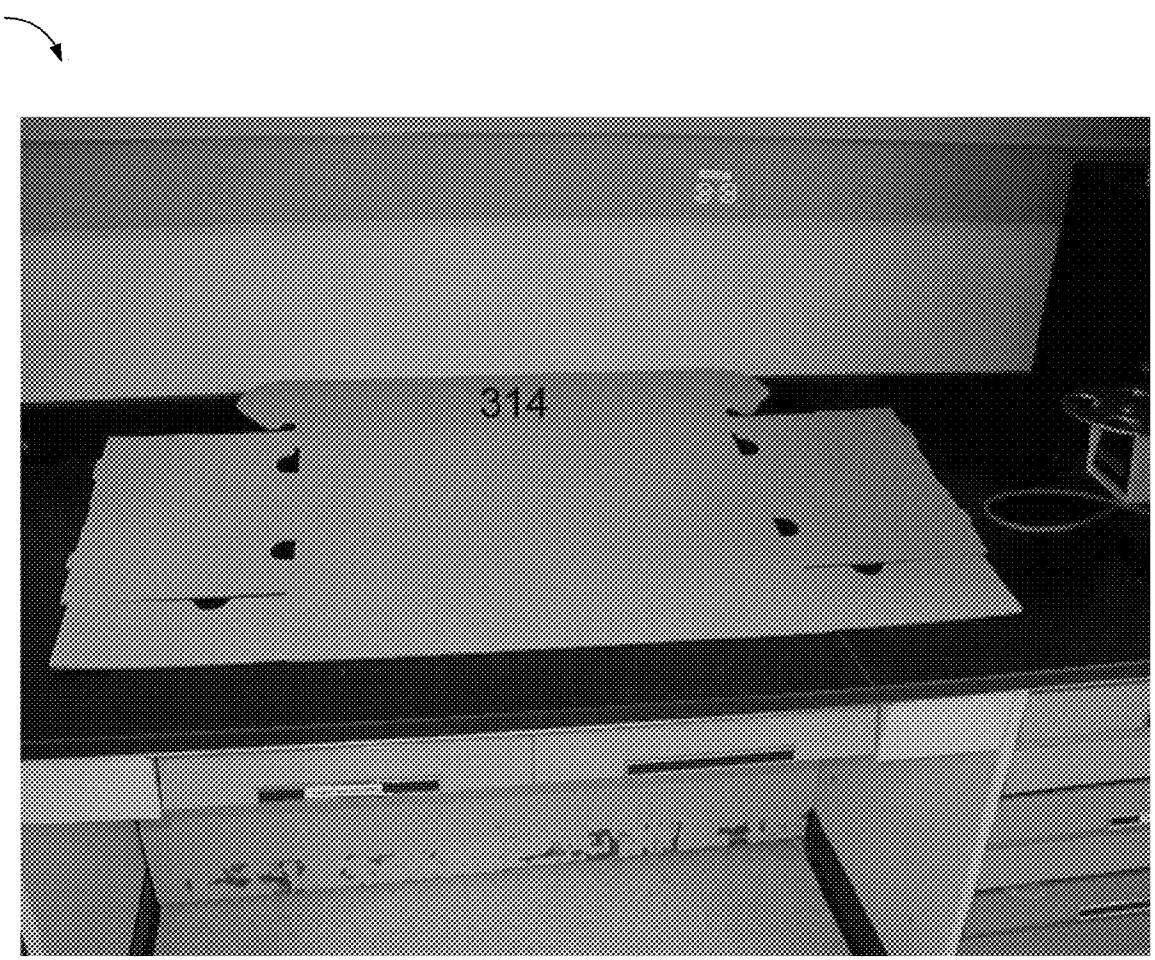

FIGS. 3A-C provide photographs of an exemplary shipping container 300 similar to that described in FIGS. 2A-2B. Specifically, FIG. 3A provides the shipping container in three pieces of tray 310, top lid 316, and bottom lid 318. FIG. 3B provides the shipping container assembled with top lid 316 and bottom lid 318 engaged with tray 310. FIG. 3C provides tray 310 in a flat configuration, i.e., before folding to form the tray 310, with flap 314 shown.

In some instances, the bottom lid may be configured to have a flap similar to that of the tray and aligns with the tray flap. Such a flap may advantageously allow for opening the shipping container or tray in a traditional fashion without removing the bottom lid. Such flaps, in some instances may be creased or hinged.

Figure 4:
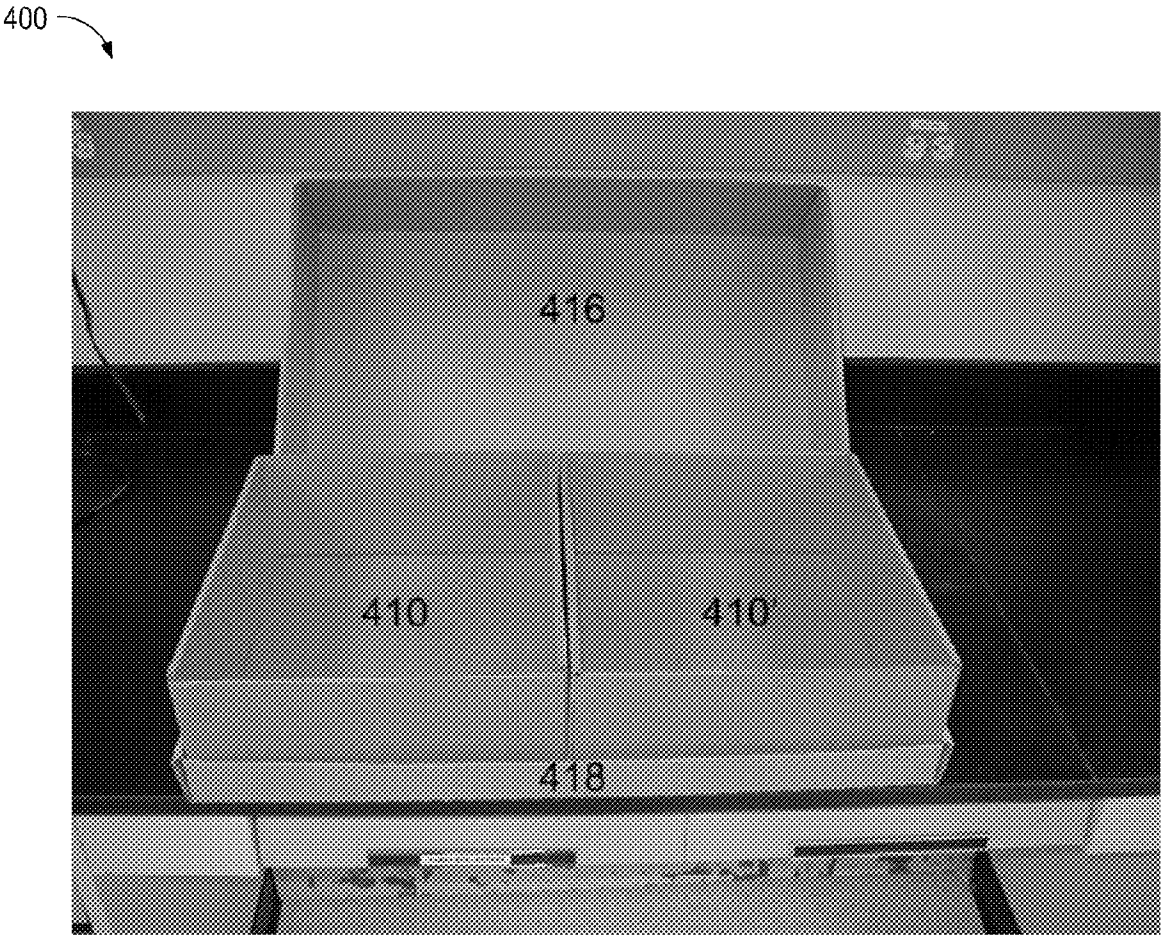
FIG. 4 provides a photograph of an exemplary two-tray shipping container according to some embodiments described herein.

In some instances, a shipping container may be configured to hold two or more trays. For example, FIG. 4 provides a photograph of an exemplary shipping container 400 with two trays 410,410', bottom lid 418 engaged with trays 410,410', and top lid 416 not engaged with trays 410,410', so as to provide a better view of trays 410,410'.

In some embodiments, a shipping container described herein may comprise a shipping container comprising a bottom lid having a rectangular lid bottom and four bottom rims that are each continuous with the lid bottom; a plurality of trays each comprising a tray bottom and four tray sidewalls that are each continuous with the bottom defining an interior with an open top; and a top lid having a rectangular lid top and four top rims that are each continuous with the lid top, wherein the bottom lid is configured to accept the plurality of trays with the bottom rims surrounding a portion of the exposed tray sidewalls of the plurality of trays with a top lid placed over the top of the plurality of trays with the top rims surrounding a portion of the exposed tray sidewalls of the plurality of trays.

In some embodiments, a shipping container described herein may comprise a shipping container comprising a top lid having a top rim; a bottom lid having a bottom rim; a first tray having a first length and a first width; and a second tray having a second length and a second width, wherein at least one of the second length and second width are selected such that an integer number of second trays has an overall dimension that is approximately equal to the equivalent dimension of the first tray, wherein the bottom lid is configured to accept a single first tray or a plurality of second trays with the bottom rims surrounding a portion of the accepted trays and the top lid is configured to fit over the accepted trays with the top rims surrounding a portion of the accepted trays.

In some instances, the tray may comprise a flap on the length or width of the tray. In some instances, the bottom lid may comprise a flap corresponding to the flap of the tray or trays disposed therein.

The material of the components of the shipping container (e.g., the trays, the lids, and any other reinforcing structure) may independently be chosen to provide the necessary strength for shipping the porous mass lengths described herein. In some instances, porous mass lengths in an amount to fill a tray shown in FIG. 3A may be about 9 kg to about 15 kg depending on the composition of the porous mass rods. Correspondingly, for a half-tray shown in FIG. 4, the porous mass lengths may be about 4.5 kg to about 7.5 kg.

Figure 5:
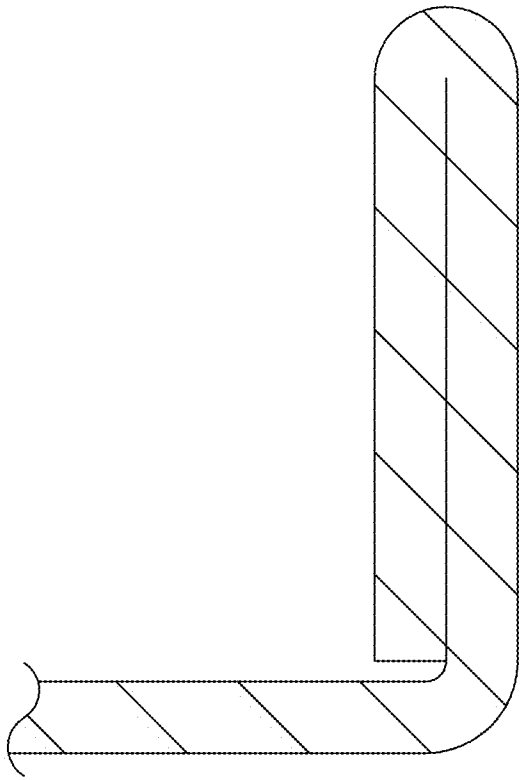
FIG. 5 illustrates a portion of a cardboard piece folded over on itself to provide for a 2-ply cardboard.

Suitable materials may include, but are not limited to, cardboard (e.g., 3/16" or greater), plastic, plastic mesh, metal, wood, and the like, and any combination thereof. In some preferred embodiments, cardboard may be 6/16" thick. In some embodiments, the cardboard may have a burst strength of about 200 pounds per square inch or greater. In some embodiments, the cardboard may be multi-ply. For example, a cross-section of a lid illustrated in FIG. 5 shows a portion of a cardboard piece folded over on itself to provide for a 2-ply cardboard. In some instances, the rims of the lids may advantageously be multi-ply cardboard (e.g., 2-ply, 3-ply, and so on), so as to provide for reinforcement of tray sidewalls. By way of nonlimiting example, a tray may be made of 3/16" cardboard with portions of the tray being 2-ply, and the lids may be made of 6/16" cardboard.

In some embodiments, the materials may include chemicals with specific properties, e.g., fire retardants.

In some embodiments, shipping containers described herein may have other configurations. In some embodiments, a bottom lid and the tray may be a single piece.

In some embodiments, shipping containers described herein may comprise a top lid and a tray without a bottom lid, provided the materials of the top lid and the tray have sufficient strength to ship the porous mass lengths. In some embodiments, the trays may be multi-ply cardboard.

In some embodiments, the trays described herein may have a height commensurate with the length of the porous mass rods described herein. By way of nonlimiting example, a tray may have dimensions of about 26¾ in by about 14¼ in by about 4⅝ in. By way of another nonlimiting example, a tray may have dimensions of about 14¼ in by about 13⅜ in by about 4⅝ in.

II. Porous Masses

Generally porous masses may comprise a plurality of binder particles and a plurality of active particles mechanically bound at a plurality of contact points. The contact points may be active particle-binder contact points, binder-binder contact points, active particle-active particle contact points, and any combination thereof. As used herein, the terms "mechanical bond," "mechanically bonded," "physical bond," and the like refer to a physical connection that holds two particles at least partially together. Mechanical bonds may be rigid or flexible depending on the bonding material. Mechanical bonding may or may not involve chemical bonding. It should be understood that as used herein, the terms "particle" and "particulate" may be used interchangeably and include all known shapes of materials, including spherical and/or ovular, substantially spherical and/or ovular, discus and/or platelet, flake, ligamental, acicular, fibrous, polygonal (such as cubic), randomly shaped (such as the shape of crushed rocks), faceted (such as the shape of crystals), or any hybrid thereof. Nonlimiting examples of porous masses are described in detail in co-pending applications PCT/US2011/043264, PCT/US2011/043268, PCT/US2011/043269, and PCT/US2011/043271 all filed on Jul. 7, 2012, the entire disclosures of which are included herein by reference.

Generally porous masses may be formed from matrix materials. As used herein, the term "matrix material" refers to the precursors, e.g., binder particles and active particles, used to form porous masses. In some embodiments, the matrix material may comprise, consist of, or consist essentially of binder particles and active particles. In some embodiments, the matrix material may comprise binder particles, active particles, and additives. Nonlimiting examples of suitable binder particles, active particles, and additives are provided in this disclosure.

Porous masses may be produced through a variety of methods. For example, some embodiments may involve forming the matrix material (e.g., the active particles and binder particles) into a desired shape (e.g., with a mold), heating the matrix material to mechanically bond the matrix material together, and finishing the porous masses (e.g., cutting the porous masses to a desired length). Of the various processes/steps involved in the production of porous masses, heating may be one of the steps that limits high-throughput manufacturing. Accordingly, methods that employ rapid heating (e.g., microwave) optionally with a preheating step (e.g., indirect heating or direct contact with heated gases) may be preferred methods for enabling high-throughput manufacturing of porous masses described herein.

The length of a porous mass, or sections thereof, may range from a lower limit of about 2 mm, 3 mm, 5 mm, 10 mm, 15 mm, 20 mm, 25 mm, or 30 mm to an upper limit of about 150 mm, 100 mm, 50 mm, 25 mm, 15 mm, or 10 mm, and wherein the length may range from any lower limit to any upper limit and encompass any subset therebetween.

The circumference of a porous mass length, a porous mass, or sections thereof (wrapped or otherwise) may range from a lower limit of about 5 mm, 6 mm, 7 mm, 8 mm, 9 mm, 10 mm, 11 mm, 12 mm, 13 mm, 14 mm, 15 mm, 16 mm, 17 mm, 18 mm, 19 mm, 20 mm, 21 mm, 22 mm, 23 mm, 24 mm, 25 mm, or 26 mm to an upper limit of about 60 mm, 50 mm, 40 mm, 30 mm, 20 mm, 29 mm, 28 mm, 27 mm, 26 mm, 25 mm, 24 mm, 23 mm, 22 mm, 21 mm, 20 mm, 19 mm, 18 mm, 17 mm, or 16 mm, wherein the circumference may range from any lower limit to any upper limit and encompass any subset therebetween.

In some embodiments, porous mass sections, porous masses, and/or porous mass lengths (wrapped or otherwise) may have a void volume in the range of about 40% to about 90%. In some embodiments, porous mass sections, porous masses, and/or porous mass lengths (wrapped or otherwise) may have a void volume of about 60% to about 90%. In some embodiments, porous mass sections, porous masses, and/or porous mass lengths (wrapped or otherwise) may have a void volume of about 60% to about 85%. Void volume is the free space left after accounting for the space taken by the active particles.

In some embodiments, porous mass sections, porous masses, and/or porous mass lengths (wrapped or otherwise) may be effective at the removal of components from tobacco smoke, for example, those in the listing herein. Porous mass sections, porous masses, and/or porous mass lengths (wrapped or otherwise) may be used to reduce the delivery of certain tobacco smoke components targeted by the World Health Organization Framework Convention on Tobacco Control ("WHO FCTC"). By way of nonlimiting example, a porous mass where activated carbon is used as the active particles can be used to reduce the delivery of certain tobacco smoke components to levels below the WHO FCTC recommendations. The components may, in some embodiments, include, but not be limited to, acetaldehyde, acrolein, benzene, benzo[a]pyrene, 1,3-butadiene, and formaldehyde. Porous mass sections, porous masses, and/or porous mass lengths (wrapped or otherwise) with activated carbon may reduce acetaldehydes in a smoke stream by about 3.0% to about 6.5%/mm length of porous mass; acrolein in a smoke stream by about 7.5% to about 12%/mm length of porous mass; benzene in a smoke stream by about 5.5% to about 8.0%/mm length of porous mass; benzo[a]pyrene in a smoke stream by about 9.0% to about 21.0%/mm length of porous mass; 1,3-butadiene in a smoke stream by about 1.5% to about 3.5%/mm length of porous mass; and formaldehyde in a smoke stream by about 9.0% to about 11.0%/mm length of porous mass. In another example, porous mass sections, porous masses, and/or porous mass lengths (wrapped or otherwise) where an ion exchange resin is used as the active particles can be used to reduce the delivery of certain tobacco smoke components to below the WHO recommendations. In some embodiments, porous mass sections, porous masses, and/or porous mass lengths (wrapped or otherwise) having an ion exchange resin may reduce: acetaldehydes in a smoke stream by about 5.0% to about 7.0%/mm length of porous mass; acrolein in a smoke stream by about 4.0% to about 6.5%/mm length of porous mass; and formaldehyde in a smoke stream by about 9.0% to about 11.0%/mm length of porous mass. One of ordinary skill in the art should understand that the values reported here relative to the concentration of specific smoke stream components may vary by test protocol and tobacco blend. The reductions cited herein refer to carbonyl testing by a method similar to the CORESTA Recommended Method No. 74, Determination of Selected Carbonyls in Mainstream Cigarette Smoke by High Performance Liquid Chromatography, using the Health Canada Intense Smoking Protocol. The sample cigarettes were prepared from a US commercial brand by manually replacing the standard cellulose acetate filter with a dual segmented filter consisting of porous mass segments and cellulose acetate segments. The length of the porous mass segment varied between 5 and 15 mm.

There may be any weight ratio of active particles to binder particles in the matrix material. In some embodiments, the matrix material may comprise active particles in an amount ranging from a lower limit of about 1 wt %, 5 wt %, 10 wt %, 25 wt %, 40 wt %, 50 wt %, 60 wt %, or 75 wt % of the matrix material to an upper limit of about 99 wt %, 95 wt %, 90 wt %, or 75 wt % of the matrix material, and wherein the amount of active particles can range from any lower limit to any upper limit and encompass any subset therebetween. In some embodiments, the matrix material may comprise binder particles in an amount ranging from a lower limit of about 1 wt %, 5 wt %, 10 wt %, or 25 wt % of the matrix material to an upper limit of about 99 wt %, 95 wt %, 90 wt %, 75 wt %, 60 wt %, 50 wt %, 40 wt %, or 25 wt % of the matrix material, and wherein the amount of binder particles can range from any lower limit to any upper limit and encompass any subset therebetween.

The active particles may be any material adapted to enhance smoke flowing thereover. Adapted to enhance smoke flowing thereover refers to any material that can remove, reduce, or add components to a smoke stream. The removal or reduction (or addition) may be selective. By way of example, in the smoke stream from a cigarette, compounds such as those shown below in the following listing may be selectively removed or reduced. This table is available from the U.S. FDA as a Draft Proposed Initial List of Harmful/Potentially Harmful Constituents in Tobacco Products, including Tobacco Smoke; any abbreviations in the below listing are well-known chemicals in the art. In some embodiments, the active particle may reduce or remove at least one component selected from the listing of components in smoke below, including any combination thereof. Smoke stream components may include, but not be limited to, acetaldehyde, acetamide, acetone, acrolein, acrylamide, acrylonitrile, aflatoxin B-1, 4-aminobiphenyl, 1-aminonaphthalene, 2-aminonaphthalene, ammonia, ammonium salts, anabasine, anatabine, 0-anisidine, arsenic, A-a-C, benz[a]anthracene, benz[b]fluoroanthene, benz[j]aceanthrylene, benz[k]fluoroanthene, benzene, benzo(b)furan, benzo[a]pyrene, benzo[c]phenanthrene, beryllium, 1,3-butadiene, butyraldehyde, cadmium, caffeic acid, carbon monoxide, catechol, chlorinated dioxins/furans, chromium, chrysene, cobalt, coumarin, a cresol, crotonaldehyde, cyclopenta[c,d]pyrene, dibenz(a,h)acridine, dibenz(a,j)acridine, dibenz[a,h]anthracene, dibenzo(c,g)carbazole, dibenzo[a,e]pyrene, dibenzo[a,h]pyrene, dibenzo[a,i]pyrene, dibenzo[a,l]pyrene, 2,6-dimethylaniline, ethyl carbamate (urethane), ethylbenzene, ethylene oxide, eugenol, formaldehyde, furan, glu-P-1, glu-P-2, hydrazine, hydrogen cyanide, hydroquinone, indeno[1,2,3-cd]pyrene, IQ, isoprene, lead, MeA-a-C, mercury, methyl ethyl ketone, 5-methylchrysene, 4-(methylnitrosamino)-1-(3-pyridyl)-1-butanone (NNK), 4-(methylnitrosamino)-1-(3-pyridyl)-1-butanol (NNAL), naphthalene, nickel, nicotine, nitrate, nitric oxide, a nitrogen oxide, nitrite, nitrobenzene, nitromethane, 2-nitropropane, N-nitrosoanabasine (NAB), N-nitrosodiethanolamine (NDELA), N-nitrosodiethylamine, N-nitrosodimethylamine (NDMA), N-nitrosoethylmethylamine, N-nitrosomorpholine (NMOR), N-nitrosonornicotine (NNN), N-nitrosopiperidine (NPIP), N-nitrosopyrrolidine (NPYR), N-nitrososarcosine (NSAR), phenol, PhIP, polonium-210 (radio-isotope), propionaldehyde, propylene oxide, pyridine, quinoline, resorcinol, selenium, styrene, tar, 2-toluidine, toluene, Trp-P-1, Trp-P-2, uranium-235 (radio-isotope), uranium-238 (radio-isotope), vinyl acetate, vinyl chloride, and any combination thereof.

One example of an active particle is activated carbon (or activated charcoal or active coal). The activated carbon may be low activity (about 50% to about 75% $CCl_4$ adsorption) or high activity (about 75% to about 95% $CCl_4$ adsorption) or a combination of both. In some embodiments, the active carbon may be nano-scaled carbon particle, such as carbon nanotubes of any number of walls, carbon nanohorns, bamboo-like carbon nanostructures, fullerenes and fullerene aggregates, and graphene including few layer graphene and oxidized graphene. Other examples of active particles may include, but are not limited to, ion exchange resins, desiccants, silicates, molecular sieves, silica gels, activated alumina, zeolites, perlite, sepiolite, Fuller's Earth, magnesium silicate, metal oxides (e.g., iron oxide, iron oxide nanoparticles like about 12 nm $Fe_3O_4$, manganese oxide, copper oxide, and aluminum oxide), gold, platinum, iodine pentoxide, phosphorus pentoxide, nanoparticles (e.g., metal nanoparticles like gold and silver; metal oxide nanoparticles like alumina; magnetic, paramagnetic, and superparamagnetic nanoparticles like gadolinium oxide, various crystal structures of iron oxide like hematite and magnetite, gado-nanotubes, and endofullerenes like $Gd@C_{60}$; and core-shell and onionated nanoparticles like gold and silver nanoshells, onionated iron oxide, and others nanoparticles or microparticles with an outer shell of any of said materials) and any combination of the foregoing (including activated carbon). Ion exchange resins include, for example, a polymer with a backbone, such as styrene-divinyl benzene (DVB) copolymer, acrylates, methacrylates, phenol formaldehyde condensates, and epichlorohydrin amine condensates; and a plurality of electrically charged functional groups attached to the polymer backbone. In some embodiments, the active particles are a combination of various active particles. In some embodiments, the porous mass may comprise multiple active particles. In some embodiments, an active particle may comprise at least one element selected from the group of active particles disclosed herein. It should be noted that "element" is being used as a general term to describe items in a list. In some embodiments, the active particles are combined with at least one flavorant.

Suitable active particles may have at least one dimension of about less than one nanometer, such as graphene, to as large as a particle having a diameter of about 5000 microns. Active particles may range from a lower size limit in at least one dimension of about: 0.1 nanometers, 0.5 nanometers, 1 nanometer, 10 nanometers, 100 nanometers, 500 nanometers, 1 micron, 5 microns, 10 microns, 50 microns, 100 microns, 150 microns, 200 microns, or 250 microns. The active particles may range from an upper size limit in at least one dimension of about: 5000 microns, 2000 microns, 1000 microns, 900 microns, 700 microns, 500 microns, 400 microns, 300 microns, 250 microns, 200 microns, 150 microns, 100 microns, 50 microns, 10 microns, or 500 nanometers. Any combination of lower limits and upper limits above may be suitable for use in the present invention, wherein the selected maximum size is greater than the selected minimum size. In some embodiments, the active particles may be a mixture of particle sizes ranging from the above lower and upper limits. In some embodiments, the size of the active particles may be polymodal.

The binder particles may be any suitable thermoplastic binder particles. In one embodiment, the binder particles exhibit virtually no flow at its melting temperature. This means a material that when heated to its melting temperature exhibits little to no polymer flow. Materials meeting these criteria include, but are not limited to, ultrahigh molecular weight polyethylene, very high molecular weight polyethylene, high molecular weight polyethylene, and combinations thereof. In one embodiment, the binder particles have a melt flow index (MFI, ASTM D1238) of less than or equal to about 3.5 g/10 min at 190° C. and 15 kg (or about 0-3.5 g/10 min at 190° C. and 15 kg). In another embodiment, the binder particles have a melt flow index (MFI) of less than or equal to about 2.0 g/10 min at 190° C. and 15 kg (or about 0-2.0 g/10 min at 190° C. and 15 kg). One example of such a material is ultra high molecular weight polyethylene, UHMWPE (which has no polymer flow, MFI of about 0, at 190° C. and 15 kg, or an MFI of about 0-1.0 at 190° C. and 15 kg); another material may be very high molecular weight polyethylene, VHMWPE (which may have MFIs in the range of, for example, about 1.0-2.0 g/10 min at 190° C. and 15 kg); or high molecular weight polyethylene, HMWPE (which may have MFIs of, for example, about 2.0-3.5 g/10 min at 190° C. and 15 kg). In some embodiments, it may be preferable to use a mixture of binder particles having different molecular weights and/or different melt flow indexes.

In terms of molecular weight, "ultra-high molecular weight polyethylene" as used herein refers to polyethylene compositions with weight-average molecular weight of at least about $3\times10^6$ g/mol. In some embodiments, the molecular weight of the ultra-high molecular weight polyethylene composition is between about $3\times10^6$ g/mol and about $30\times10^6$ g/mol, or between about $3\times10^6$ g/mol and about $20\times10^6$ g/mol, or between about $3\times10^6$ g/mol and about $10\times10^6$ g/mol, or between about $3\times10^6$ g/mol and about $6\times10^6$ g/mol. "Very-high molecular weight polyethylene" refers to polyethylene compositions with a weight average molecular weight of less than about $3\times10^6$ g/mol and more than about $1\times10^6$ g/mol. In some embodiments, the molecular weight of the very-high molecular weight polyethylene composition is between about $2\times10^6$ g/mol and less than about $3\times10^6$ g/mol. "High molecular weight polyethylene" refers to polyethylene compositions with weight-average molecular weight of at least about $3\times^{105}$ g/mol to $1\times10^6$ g/mol. For purposes of the present specification, the molecular weights referenced herein are determined in accordance with the Margolies equation ("Margolies molecular weight").

Suitable polyethylene materials are commercially available from several sources including GUR® UHMWPE from Ticona Polymers LLC, a division of Celanese Corporation of Dallas, Tex., and DSM (Netherland), Braskem (Brazil), Beijing Factory No. 2 (BAAF), Shanghai Chemical, and Qilu (People's Republic of China), Mitsui and Asahi (Japan). Specifically, GUR® polymers may include: GUR® 2000 series (2105, 2122, 2122-5, 2126), GUR® 4000 series (4120, 4130, 4150, 4170, 4012, 4122-5, 4022-6, 4050-3/4150-3), GUR® 8000 series (8110, 8020), GUR® X series (X143, X184, X168, X172, X192).

One example of a suitable polyethylene material is that having an intrinsic viscosity in the range of about 5 dl/g to about 30 dl/g and a degree of crystallinity of about 80% or more as described in U.S. Patent Application Publication No. 2008/0090081. Another example of a suitable polyethylene material is that having a molecular weight in the range of about 300,000 g/mol to about 2,000,000 g/mol as determined by ASTM-D 4020, an average particle size, D50, between about 300 μm and about 1500 μm, and a bulk density between about 0.25 g/ml and about 0.5 g/ml as described in International Application No. PCT/US2011/034947 filed May 3, 2011.

The binder particles may assume any shape. Such shapes include spherical, hyperion, asteroidal, chrondular or interplanetary dust-like, granulated, potato, irregular, or combinations thereof. In preferred embodiments, the binder particles suitable for use in the present invention are non-fibrous. In some embodiments the binder particles are in the form of a powder, pellet, or particulate. In some embodiments, the binder particles are a combination of various binder particles.

In some embodiments, the binder particles may range from a lower size limit in at least one dimension of about: 0.1 nanometers, 0.5 nanometers, 1 nanometer, 10 nanometers, 100 nanometers, 500 nanometers, 1 micron, 5 microns, 10 microns, 50 microns, 100 microns, 150 microns, 200 microns, and 250 microns. The binder particles may range from an upper size limit in at least one dimension of about: 5000 microns, 2000 microns, 1000 microns, 900 microns, 700 microns, 500 microns, 400 microns, 300 microns, 250 microns, 200 microns, 150 microns, 100 microns, 50 microns, 10 microns, and 500 nanometers. Any combination of lower limits and upper limits above may be suitable for use in the present invention, wherein the selected maximum size is greater than the selected minimum size. In some embodiments, the binder particles may be a mixture of particle sizes ranging from the above lower and upper limits. In some embodiments, smaller diameter particles may be advantageous in faster heating for binding of the binder particles together, which may be especially useful in high-throughput processes for producing porous masses described herein.

While the ratio of binder particle size to active particle size can include any iteration as dictated by the size ranges for each described herein, specific size ratios may be advantageous for specific applications and/or products. By way of nonlimiting example, in smoking device filters the sizes of the active particles and binder particles should be such that the EPD allows for drawing fluids through the porous mass. In some embodiments, the ratio of binder particle size to active particle size may range from about 10:1 to about 1:10, or more preferably range from about 1:1.5 to about 1:4.

Additionally, the binder particles may have a bulk density in the range of about 0.10 g/cm3 to about 0.55 g/cm3. In another embodiment, the bulk density may be in the range of about 0.17 g/cm3 to about 0.50 g/cm3. In yet another embodiment, the bulk density may be in the range of about 0.20 g/cm3 to about 0.47 g/cm3.

In addition to the foregoing binder particles, other conventional thermoplastics may be used as binder particles. Such thermoplastics include, but are not limited to, polyolefins, polyesters, polyamides (or nylons), polyacrylics, polystyrenes, polyvinyls, polytetrafluoroethylene (PTFE), polyether ether ketone (PEEK), any copolymer thereof, any derivative thereof, and any combination thereof. Non-fibrous plasticized cellulose derivatives may also be suitable for use as binder particles in the present invention. Examples of suitable polyolefins include, but are not limited to, polyethylene, polypropylene, polybutylene, polymethylpentene, any copolymer thereof, any derivative thereof, any combination thereof, and the like. Examples of suitable polyethylenes further include low-density polyethylene, linear low-density polyethylene, high-density polyethylene, any copolymer thereof, any derivative thereof, any combination thereof, and the like. Examples of suitable polyesters include polyethylene terephthalate, polybutylene terephthalate, polycyclohexylene dimethylene terephthalate, polytrimethylene terephthalate, any copolymer thereof, any derivative thereof, any combination thereof, and the like. Examples of suitable polyacrylics include, but are not limited to, polymethyl methacrylate, any copolymer thereof, any derivative thereof, any combination thereof, and the like. Examples of suitable polystyrenes include, but are not limited to, polystyrene, acrylonitrile-butadiene-styrene, styrene-acrylonitrile, styrene-butadiene, styrene-maleic anhydride, any copolymer thereof, any derivative thereof, any combination thereof, and the like. Examples of suitable polyvinyls include, but are not limited to, ethylene vinyl acetate, ethylene vinyl alcohol, polyvinyl chloride, any copolymer thereof, any derivative thereof, any combination thereof, and the like. Examples of suitable cellulosics include, but are not limited to, cellulose acetate, cellulose acetate butyrate, plasticized cellulosics, cellulose propionate, ethyl cellulose, any copolymer thereof, any derivative thereof, any combination thereof, and the like. In some embodiments, a binder particle may be any copolymer, any derivative, and any combination of the above listed binders.

In some embodiments, matrix materials and/or porous masses may comprise active particles, binder particles, and additives. In some embodiments, the matrix material or porous masses may comprise additives in an amount ranging from a lower limit of about 0.01 wt %, 0.05 wt %, 0.1 wt %, 1 wt %, 5 wt %, or 10 wt % of the matrix material or porous masses to an upper limit of about 25 wt %, 15 wt %, 10 wt %, 5 wt %, or 1 wt % of the matrix material or porous masses, and wherein the amount of additives can range from any lower limit to any upper limit and encompass any subset therebetween. It should be noted that porous masses as referenced herein include porous mass lengths, porous masses, and porous mass sections (wrapped or otherwise).

Suitable additives may include, but not be limited to, active compounds, ionic resins, zeolites, nanoparticles, microwave enhancement additives, ceramic particles, glass beads, softening agents, plasticizers, pigments, dyes, flavorants, aromas, controlled release vesicles, adhesives, tackifiers, surface modification agents, vitamins, peroxides, biocides, antifungals, antimicrobials, antistatic agents, flame retardants, degradation agents, and any combination thereof.

Embodiments disclosed herein include:

A: a shipping container that includes a bottom lid having a rectangular lid bottom and four bottom rims that are each continuous with the lid bottom; a tray comprising a tray bottom and four tray sidewalls that are each continuous with the tray bottom defining an interior with an open top; and a top lid having a rectangular lid top and four top rims that are each continuous with the lid top, wherein the tray is configured to be placed on a bottom lid with the bottom rims surrounding a portion of the tray with a top lid placed over the top of the tray with the top rims surrounding a portion of the tray;

B: a shipping container that includes a bottom lid having a rectangular lid bottom and four bottom rims that are each continuous with the lid bottom; a plurality of trays each comprising a tray bottom and four tray sidewalls that are each continuous with the bottom defining an interior with an open top; and a top lid having a rectangular lid top and four top rims that are each continuous with the lid top, wherein the bottom lid is configured to accept the plurality of trays with the bottom rims surrounding a portion of the exposed tray sidewalls of the plurality of trays with a top lid placed over the top of the plurality of trays with the top rims surrounding a portion of the exposed tray sidewalls of the plurality of trays; and C: a shipping container that includes a top lid having a top rim; a bottom lid having a bottom rim; a first tray having a first length and a first width; and a second tray having a second length and a second width, wherein at least one of the second length and second width are selected such that an integer number of second trays has an overall dimension that is approximately equal to the equivalent dimension of the first tray, wherein the bottom lid is configured to accept a single first tray or a plurality of second trays with the bottom rims surrounding a portion of the accepted trays and the top lid is configured to fit over the accepted trays with the top rims surrounding a portion of the accepted trays.

Each of embodiments A, B, and C may have one or more of the following additional elements in any combination: Element 1: the top lid and the bottom lid are each formed from a single piece of cardboard material having a burst strength of about 200 pounds per square inch or greater; Element 2: the tray (or at least one of the trays) is formed from a single piece of cardboard material having a about 200 pounds per square inch or greater; Element 3: at least one of the four tray sidewalls is a flap; Element 4: at least one of the bottom rims is a flap; Element 5: the top lid and the bottom lid are configured to touch when placed on the tray(s); Element 6: the top lid, the bottom lid, the tray(s), or any combination thereof are formed at least in part by a plastic material; and Element 7: the top lid, the bottom lid, the tray(s), or any combination thereof are formed at least in part by a 5/16" cardboard.

By way of non-limiting example, exemplary combinations independently applicable to A, B, and C include: Element 3 in combination with Element 4; Elements 3, 4, and 7 in combination; Element 3 in combination with Element 7; Element 3 in combination with Element 6; Element 5 in combination with the foregoing any of the combinations; and so on.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein.

While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. A shipping container, comprising:

a shipping container comprising a bottom lid having a rectangular lid bottom and four bottom rims that are each continuous with the lid bottom;

a plurality of trays each comprising a tray bottom and four tray sidewalls that are each continuous with the tray bottom and form corners at intersections between the four tray sidewalls so as to define an interior with an open top, and wherein at least one of the four tray sidewalls is a flap configured for opening the tray; and a top lid having a rectangular lid top and four top rims that are each continuous with the lid top, wherein the bottom lid is configured to accept the plurality of trays with the bottom rims surrounding a portion of at least one exposed tray sidewall and at least one corner of each of the plurality of trays and the top lid is configured such that when placed over the open top of the plurality of trays the top rims surround a portion of the at least one exposed tray sidewall and the at least one corner of the plurality of trays.

2. The shipping container of claim 1, wherein the top lid and the bottom lid are each formed from a single piece of cardboard material having a burst strength of about 200 pounds per square inch or greater.

3. The shipping container of claim 1, wherein the trays are each formed from a single piece of cardboard material having a burst strength of about 200 pounds per square inch or greater.

4. The shipping container of claim 1, wherein at least one of the bottom rims is a flap.

5. A configurable shipping container comprising a top lid having a top rim;

a bottom lid having a bottom rim;

a first tray having a first length and a first width; and a second tray having a second length and a second width, wherein at least one of the second length and second width are selected such that an integer number of second trays has an overall dimension that is approximately equal to an equivalent dimension of the first tray, wherein each of the first and second trays comprise a tray bottom and four tray sidewalls that are each continuous with the tray bottom and form corners at intersections between the four tray sidewalls so as to define an interior with an open top, and wherein at least one of the four tray sidewalls is a flap configured for opening the tray;

wherein the bottom lid is configured to receive an accepted tray selected from the group consisting of a single first tray and a plurality of second trays such that the bottom rim surrounds a portion of the accepted tray including at least one of the corners of the accepted tray; and wherein the top lid is configured to fit over the accepted tray such that the top rim surrounds the portion of the accepted trays including the at least one of the corners of the accepted tray.

6. The shipping container of claim 5, wherein the top lid and the bottom lid are each formed from a single piece of cardboard material having a burst strength of about 200 pounds per square inch or greater.

7. The shipping container of claim 5, wherein the first tray is formed from a single piece of cardboard material having a burst strength of about 200 pounds per square inch or greater.

8. The shipping container of claim 5, wherein the second tray is formed from a single piece of cardboard material having a burst strength less than or equal to 200 pounds per square inch.

9. The shipping container of claim 5, wherein at least one of the bottom rims is a flap.

* * * * *